US007926132B2

(12) United States Patent
Jordan

(10) Patent No.: US 7,926,132 B2
(45) Date of Patent: Apr. 19, 2011

(54) RESCUE LITTER ATTACHMENT SYSTEM

(76) Inventor: Dana Jordan, Sandpoint, ID (US)

( * ) Notice: Subject to any disclaimer, the term of this patent is extended or adjusted under 35 U.S.C. 154(b) by 228 days.

(21) Appl. No.: 11/700,551

(22) Filed: Jan. 30, 2007

(65) Prior Publication Data

US 2008/0178383 A1 Jul. 31, 2008

(51) Int. Cl.
*A47C 31/00* (2006.01)

(52) U.S. Cl. ..... 5/626; 5/625; 5/658

(58) Field of Classification Search ..... 5/625–629, 5/658; 24/265 AL
See application file for complete search history.

(56) References Cited

U.S. PATENT DOCUMENTS

| | | | | |
|---|---|---|---|---|
| 1,557,647 | A | | 10/1925 | Austin |
| 2,400,426 | A | | 5/1946 | Liptay et al. |
| 3,135,972 | A | | 6/1964 | Jakes et al. |
| 3,222,080 | A | | 12/1965 | Kinraide |
| 3,408,664 | A | * | 11/1968 | Jarman ..... 5/627 |
| 3,890,659 | A | | 6/1975 | Staubs |
| 4,005,904 | A | * | 2/1977 | Weman et al. ..... 297/483 |
| 4,183,110 | A | | 1/1980 | Kidd et al. |
| 4,564,161 | A | | 1/1986 | Frye |
| D311,713 | S | | 10/1990 | McAfee et al. |
| 5,005,266 | A | | 4/1991 | Fister et al. |
| 5,156,233 | A | | 10/1992 | Olsen et al. |
| 5,249,321 | A | | 10/1993 | Graf |
| 5,398,358 | A | | 3/1995 | Mercke et al. |
| D361,665 | S | * | 8/1995 | Izumi ..... D3/318 |
| 6,527,285 | B1 | | 3/2003 | Calandro, II |
| 6,859,963 | B2 | | 3/2005 | Sawatzky |

OTHER PUBLICATIONS

Cascade Toboggan, 2001-2002 Catalogue, pp. 4-5, Sandpoint, Idaho, USA.
Traverse Rescue, Winter Catalogue 2002, pp. 12-13, Kelowna, B.C. Canada.
Cascade Toboggan, 2005-2006 Catalogue, pp. 6-7, Sandpoint, Idaho, USA.

* cited by examiner

*Primary Examiner* — Shane Bomar
*Assistant Examiner* — Gilbert Y Lee
(74) *Attorney, Agent, or Firm* — Wells St. John, PS

(57) ABSTRACT

This invention discloses a rescue stretcher or rescue litter and which includes a variable angle rail adapter with an adapter body with rail apertures configured for rotatable mounting around a stretcher rail and an attachment aperture transverse to the rail aperture configured to transversely receive attachment components therein.

14 Claims, 9 Drawing Sheets

RESCUE LITTER ATTACHMENT SYSTEM

CROSS REFERENCE TO RELATED APPLICATION

This application does not claim priority from any other application.

TECHNICAL FIELD

This invention relates to a versatile rescue litter attachment system which provides a variable angle rail adapter which may be pivoted about one of the rails and used in multiple applications and arrangements.

BACKGROUND OF THE INVENTION

Rescue stretchers and rescue litters have been used for many years for rescue operations in the outdoors and there are numerous different types and configurations of basket type rescue stretchers or litters. The litters generally include some type of bottom support or framework for supporting the weight of the person or animal to be rescued, along with a side framework for further containing the person to be rescued. The litter frameworks may be made of any one of a number of different types of materials or configurations all within the scope of use of rescue baskets or litters, and within the scope of this invention. Most of the litters will include a top rail and some type of connective framework for attaching the top rail to other intermediate or lower components including the bottom framework. The bottom framework may be more formally a framework or a litter bottom surface.

There are also numerous situations encountered in the use of litters in rescue operations that require the tethering and manipulation of the litter to be somewhat flexible to accommodate the different applications.

In some prior art rescue systems, conventional baskets are utilized and carabiners attached to tethers are hooked at various points around the upper rail and provide the connection point for the tether or system utilized to carry the stretcher. The carabiners may slide and become lodged in the wrong place or move once the litter is being lifted and are not desirable for that reason. In other prior art devices, fixed eyelets or brackets or mounting members are attached to some part of the framework of the rescue basket in a fixed manner, some on the inside and some on the outside and some of these systems do not provide the desired flexibility in the location of the eyelet or the configurability of the carabiner or other tethering device in attaching to it.

It is an object of this invention to provide a rescue litter attachment system which reliably locates the variable angle rail adapter on one of the rails, but which is moveably mounted to provide different angles and locations for operative attachment of carabiners or other connectors to attach tethers and ropes to the litter during rescue operations. Embodiments of this invention may be said to provide a variable angle rail adapter.

While the invention was motivated in addressing some objectives, it is in no way so limited. The invention is only limited by the accompanying claims as literally worded, without interpretative or other limiting reference to the specification, and in accordance with the doctrine of equivalents.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 6 is a front elevation view of a rescue litter with tethered carabiners operatively connected to the embodiment of the variable angle rail adapter illustrated in FIG. 1;

FIG. 7 is a top view of a rescue litter with tethered carabiners operatively connected to the embodiment of the variable angle rail adapter illustrated in FIG. 1 and wherein the variable angle rail adapter is rotated outwardly from the litter;

DETAILED DESCRIPTION OF THE PREFERRED EMBODIMENTS

Figures 1, 2, 3:
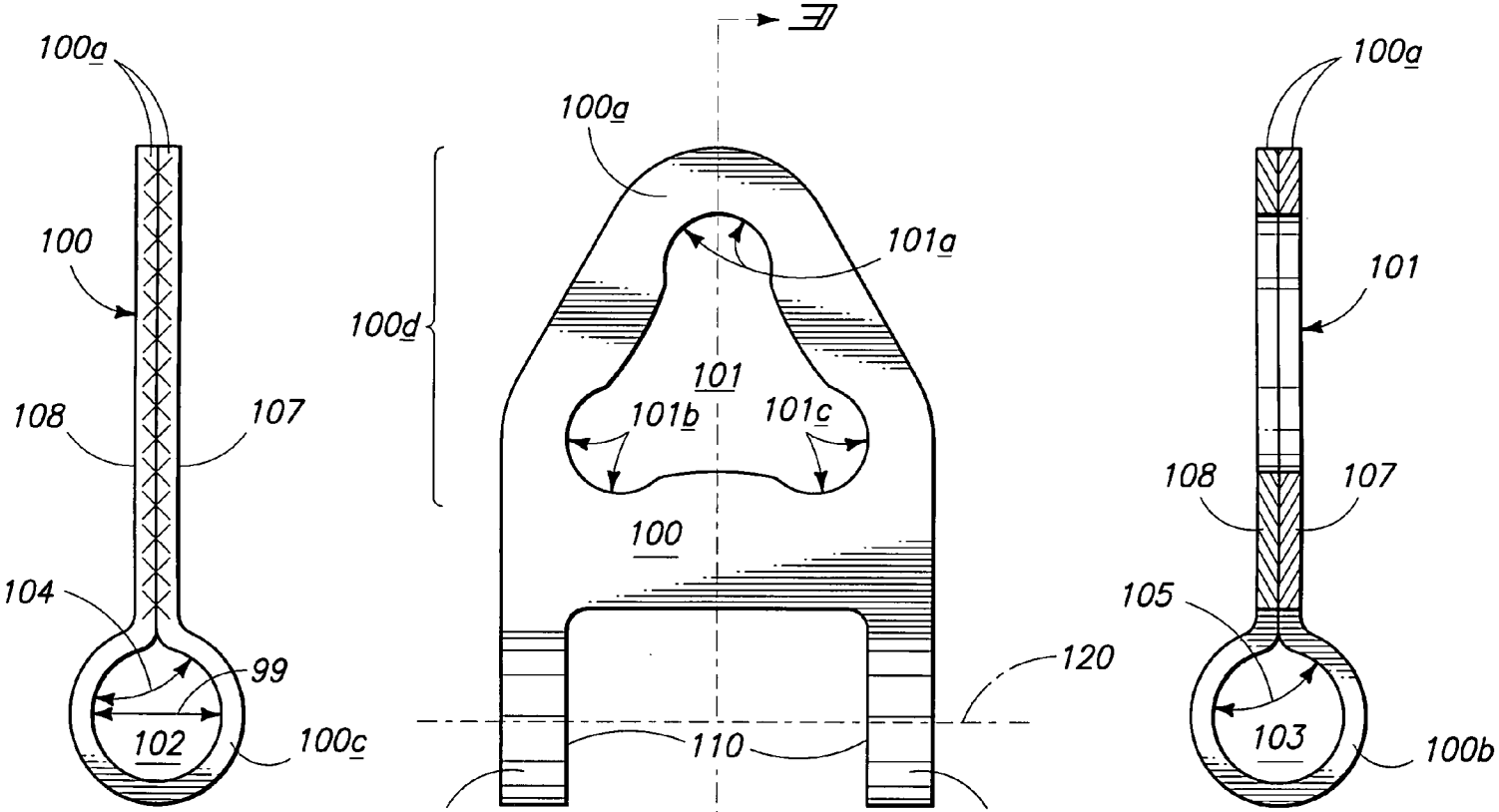
FIG. 1 is a front elevation view of one embodiment of a variable angle rail adapter that may be utilized in practicing this invention.
FIG. 2 is a first end view of the embodiment of the variable angle rail adapter illustrated in FIG. 1.
FIG. 3 is cross-section 3-3 from FIG. 1.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms “a”, “an”, and “the” as used in the claims herein are used in conformance with long-standing claim drafting practice and not in a limiting way. Unless specifically set forth herein, the terms “a”, “an”, and “the” are not limited to one of such elements, but instead mean “at least one”.

The variable angle rail adapters (which may also be referred to as a lift point, pivotal lift point or articulating lift point) provided by this invention are specifically designed to work with a number of different litters due to the nature of the design and may be attached and utilized in a variety of different positions. In embodiments of this invention, the variable angle rail adapters rotate about the axis of the topmost railing of the litter and can be utilized in any position about that access. Another feature is that when the variable angle rail adapter is not being used, it may be rotated and folded and stowed neatly inside or outside the litter, at the operator's discretion. Each of the variable angle rail adapters are designed to share in the amount of work and load applied to a litter during lifting or towing operations and the unique design facilitates the distribution of weight across multiple structural members of the litter.

The versatility of utilizing variable angle rail adapters is illustrated when the variable angle rail adapters can be used on one or more litters position between a structural horizontal tubing member of the litter and the secondary support located between the primary or top railing and the secondary or lower railing. When used in other applications, the variable angle rail adapter straddles the bracket that attaches the primary top railing to the composite body of the litter. Each of the variable angle rail adapters provide the additional benefit of distributing the weight of the litter and load from a single attachment point or nock point on the variable angle rail adapter, to two different attachment points or legs that encircle and articulate about the top railing of the litter.

It will also be a appreciated by those of ordinary skill in the art that instead of there being two rail apertures on the variable angle rail adapter, there may only be only one and the framework component otherwise attached to the rail may include to rail apertures and be configured to receive the variable angle rail adapter in between the first rail apertures second rail aperture of the framework component.

When the subject litter or basket stretcher is equipped with four variable angle rail adapters, they may be used for horizontal or vertical lift operations. Each of the variable angle rail adapters may be configured with more than one and preferably three distinct and separate slot or nock positions for lifting or weight-bearing applications. These nock points or areas appear to the fore, aft and top of the variable angle rail adapter. When in a horizontal position, the sum of the four variable angle rail adapters may be used for horizontal lifting by simply clipping a carabiner into the top nock point of each variable angle rail adapter and attaching either to a four-point harness or a two point high-line harness. The remaining nock points can then be used to attach tag or safety lines to the configuration as needed.

In the vertical configuration, the two variable angle rail adapters at the head of the litter are utilized by simply attaching a carabiner or webbing to each of the forward most nock points of the variable angle rail adapter and then to a vertical lifting harness. The lower variable angle rail adapters can be used for additional lines or harnesses as necessary for stabilization. The variable angle rail adapters may also be attached to the vertical structural tubing of the different litters for additional service as a vertical or low incline lift device.

The variable angle rail adapters may also be used during rescue or evacuation as belay points or sling attachment points and as additional patient restraint tie-in points.

FIG. 1 is a front elevation view of one embodiment of a variable angle rail adapter that may be utilized in practicing this invention. FIG. 1 illustrates variable angle rail adapter body 100 with top 100*a* and top portion 100*d* in which connector aperture or attachment aperture 101 is located. FIG. 1 shows first rail aperture 100*c* and second rail aperture 100*b* and axis 120 to apertures in first rail aperture 100*c* and second rail aperture 100*b* (apertures are not shown in FIG. 1). Within attachment aperture 101 are 3 slots or nocks, namely first connector slot 101*a*, second connector slot 101*b* and third connector slot 101*c* wherein any one of the slots may provide an indented area to better fit and retain a carabiner or other connector device. It will be appreciated by those of ordinary skill; in the art that while the attachment aperture 101 is shown with 3 slots, that any one of a number of different number of slots may be utilized within the contemplation of this invention, with no slots or no single number of slots being required to practice embodiments of this invention.

The attachment aperture 101 is located on the upper portion 100*d* of the variable angle rail adapter 100. The slot 110 between first rail aperture 100*c* and second rail aperture 100*b* (or between the legs of the variable angle rail adapter 100 which are spaced apart) is configured to be large enough to surround and be generally positioned by a litter component such as a strap or other framework with the litter component positioning it and preventing the variable angle rail adapter from sliding on the rail on which it is mounted.

The attachment aperture 101 is shown configured transverse to the first rail aperture 100*c* and second rail aperture 100*b*, although it may be configured substantially transverse, generally transverse, or pivotal so it may be manipulated between multiple angles from transverse to parallel or longitudinal.

FIG. 2 is a first end view of the embodiment of the variable angle rail adapter illustrated in FIG. 1. FIG. 2 illustrates variable angle rail adapter 100 with top and 100*a*, rail aperture 102 with inter-diameter 99 and inter-surface 104. It will be appreciated by those of ordinary skill in the art that FIG. 2 illustrates how the variable angle rail adapter 100 may be constructed out of flatplate and then bending a first body section 107 with a second body section 108 to form the rail aperture 102 and integrated or unified body combined of first body section 107 and a second body section 108. Rail aperture 102 is in reference the aperture in first rail aperture 100*c*.

FIG. 3 is cross-section 3-3 from FIG. 1. FIG. 3 illustrates second rail aperture 103 in second rail aperture 101*b* with first body section 107 and second body section 108, top end 100*a* of variable angle rail adapter 100. This cross-sectional view also shows attachment aperture 101.

Figure 4:
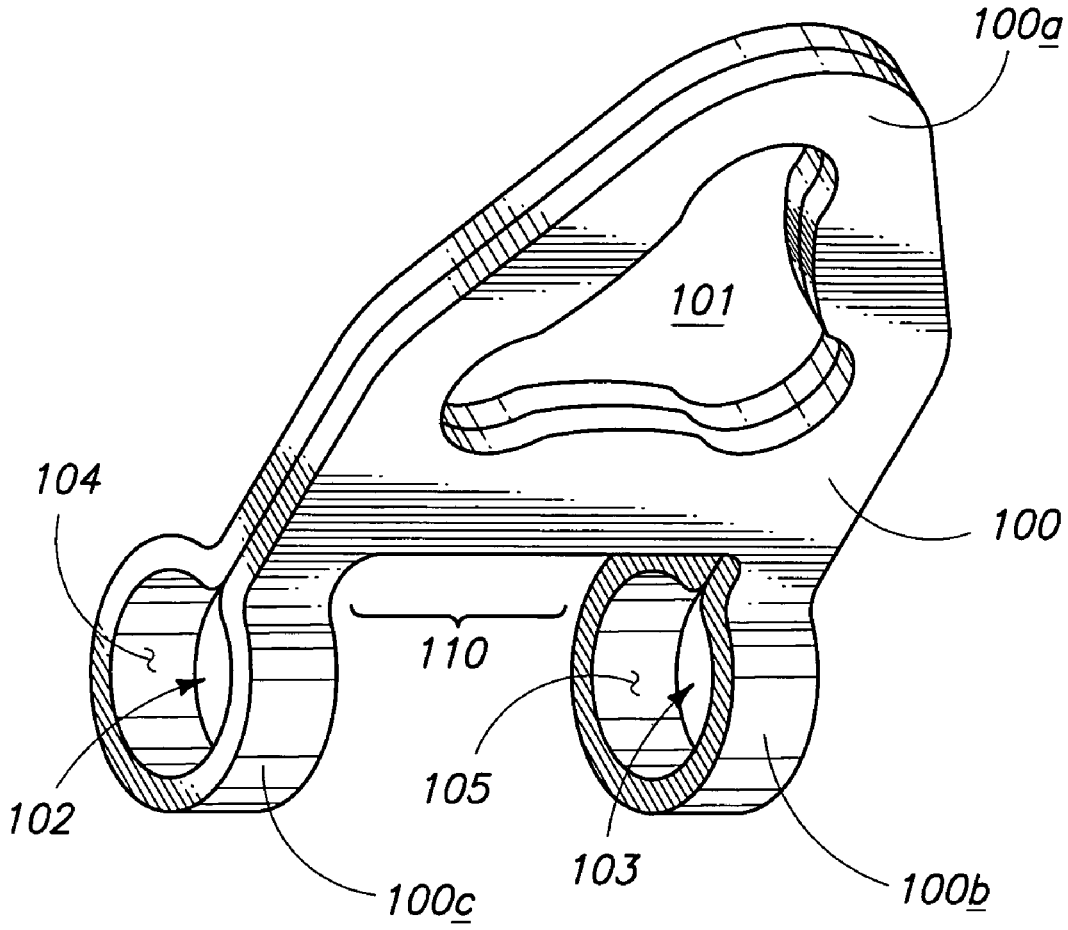
FIG. 4 is a perspective view of the variable angle rail adapter illustrated in FIG. 1.

FIG. 4 is a perspective view of the variable angle rail adapter illustrated in FIG. 1. FIG. 4 illustrates variable angle rail adapter 100 with top end 100*a*, attachment aperture 101, first rail aperture 100*c* with first rail aperture 102 and second rail aperture 100*b* with second rail aperture 103. The inner surface of 104 of first rail aperture and the inner surface 105 of second rail aperture 100*b* are also illustrated. The first rail aperture 100*c* is spaced apart from the second rail aperture 100*b* to create a slot 110 (or an area between which the first rail aperture 100*c* and the second rail aperture 100*b* are spaced apart), with the slot 110 being sizable to fit around other framework components, such as straps, solid framework cross components and others to help position the variable angle rail adapter on the rescue stretcher or rescue litter (one example of which is shown in the drawings). The slot 110 between the two legs is shown sized to straddle litter or framework component 131 or 151 as shown in other drawings. It will be appreciated by those of ordinary skill in the art that the distance between the two legs or of the slot 110 can be any one of a number of different distances to suit the application or applications, and can provide little or no tolerance in movement or a greater amount of tolerance in movement depending upon the desired application.

It will also be appreciated by those of ordinary skill in the art that the ease with which the variable angle rail adapter may be rotated can be any range of different degrees of tightness, from very tight and difficult to rotate, to freely rotatable, depending upon the specific embodiment and result desired.

Figure 5:
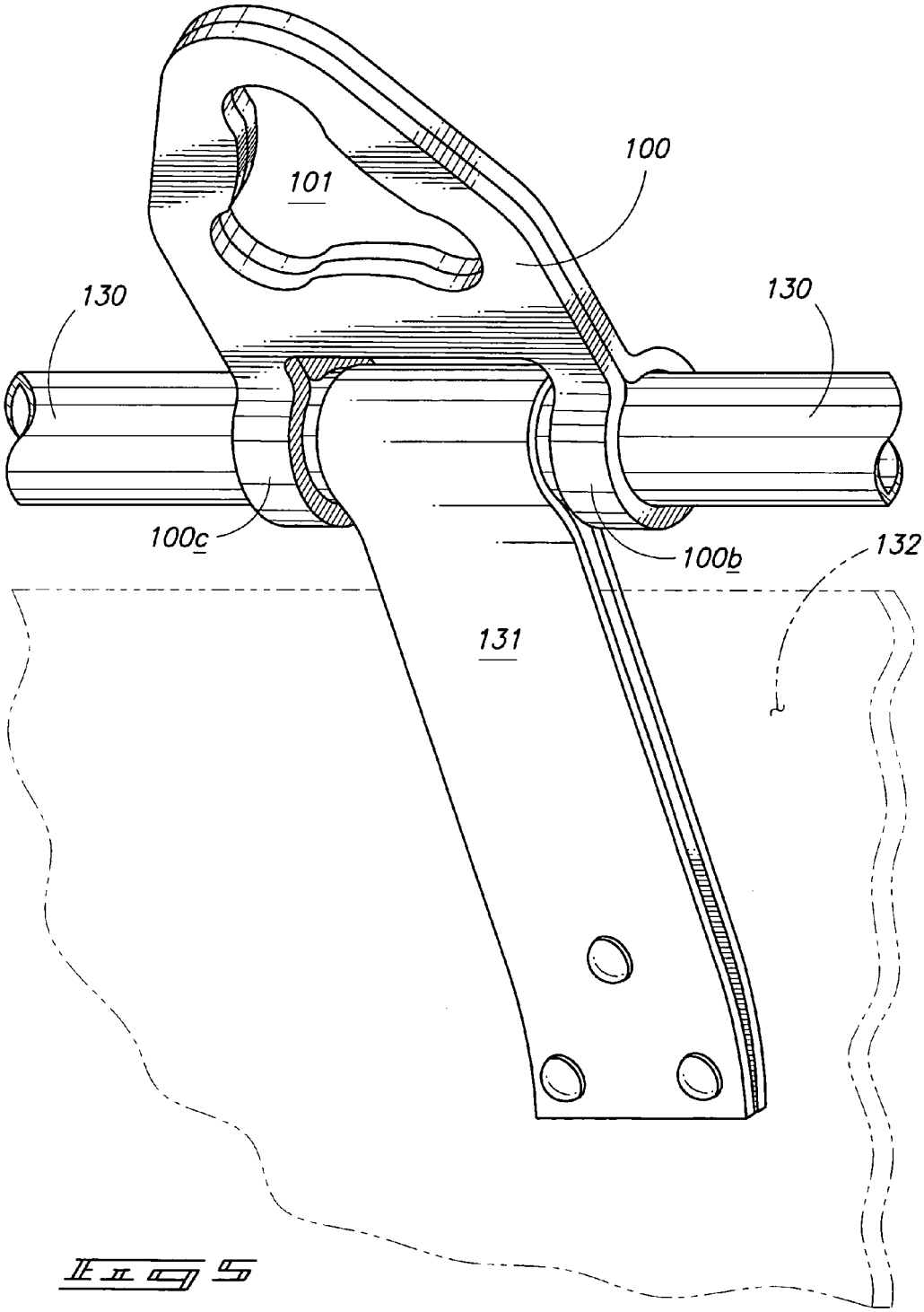
FIG. 5 is a front perspective view of the embodiment of the variable angle rail adapter illustrated in FIG. 1 moveably mounted on a top rail of a litter.

FIG. 5 is a front perspective view of the embodiment of the variable angle rail adapter illustrated in FIG. 1 moveably mounted on a top rail. FIG. 5 shows litter component 131 mounted on top rail 130 and variable angle rail adapter 100 mounted on and around top rail 130. The first rail aperture 100*c* and second rail aperture 100*b* surround top rail 130 and are sufficiently loose to allow the rotation of variable angle rail adapter 100 about the axis of top rail 130. The ability to rotate variable angle rail adapter 100 along with the universality of attachment aperture 101 and the slots therein, provide versatility in the tethering to variable angle rail adapter 100 and lifting and manipulation of the litter on which it is used. A portion of the litter 132 is shown as a side wall whereas it may merely be a framework in any given application, and the litter component 131 is attached to sidewall 132 in the example shown in FIG. 5. It will again be appreciate by those of ordinary skill in the art that this invention has application in any one of a number of different types of litters and rescue baskets with no one in particular and no one configuration being required to practice this invention.

FIG. 6 is a front elevation view of a rescue litter with tethered carabiners operatively connected to the embodiment of the variable angle rail adapter illustrated in FIG. 1. FIG. 6 illustrates tethered carabiners 156 and 161 operatively connected to tethers 157 and 162 respectively, attached to a first variable angle rail adapter 155 and a second variable angle rail adapter 160 by way of example. Other carabiners may be attached to other eyelets as well. The upper end of tethers 157 and 162 are operatively attached to ring 158 which provides a central component for tethers to be attached in this application. The arrows 159 show there may be some relative movement of variable angle rail adapter 155 relative to rail 153, but it is restricted by litter component 154 as shown because litter component 154 is positioned within the slot between the first rail aperture and the second rail aperture of the variable angle rail adapter. The same is true and shown for variable angle rail adapter 160.

FIG. 6 further shows litter sidewall 152 on litter 151, all part of the rescue litter system 150 illustrated in FIG. 6.

FIG. 7 is a top view of a rescue litter with tethered carabiners operatively connected to the embodiment of the variable angle rail adapter illustrated in FIG. 1 and wherein the variable angle rail adapter is rotated outwardly from the litter. FIG. 7 illustrates a litter with litter bottom 152, top rail 153 and litter components 154. This application illustrates one of the flexibilities of embodiments of this invention such that the variable angle rail adapters 155, 160, 170 and 173 respectively may be pivoted to any one of a number of different angles inside or outside of the litter, for whatever is necessary for the rescue operation, providing maximum flexibility. While maximum flexibility is provided also by the attachment apertures which receive components of the carabiners 156, 161, 171 and 174 respectively, that may be placed at different angles and still have recipient connector slots in which they can be held or received.

Figure 8:
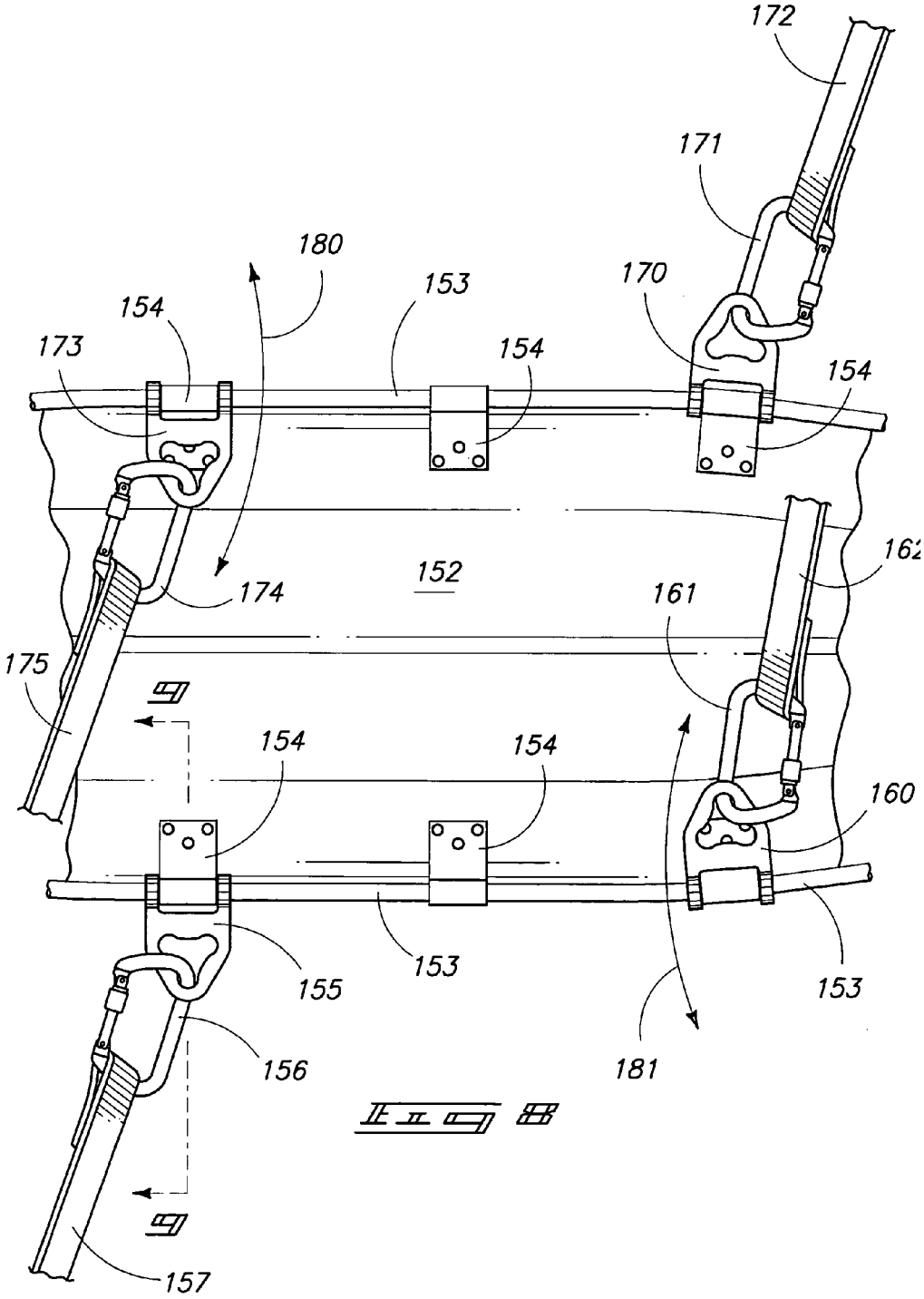
FIG. 8 is a partial top view of a rescue litter with the embodiments of the variable angle rail adapter illustrated in different positions for illustrative purposes relative to the inside and outside of the litter framework.

FIG. 8 is a partial top view of a rescue litter with the embodiments of the variable angle rail adapter illustrated in different position for illustrative purposes relative to the inside and outside of the litter framework. FIG. 8 illustrates a variety of locations and angles of the respective variable angle rail adapters 154, 160, 170 and 173. Litter bottom 152, top rail 153 and litter components 154 are illustrated as representing the exemplary litter with arrows 180 and 181 illustrating the pivotability of variable angle rail adapters 173 and 160 respectively.

FIG. 8 illustrates how the respective tethers 157, 162, 172 and 175 may be angled or utilized in different ways and which are facilitated by the pivotability of the variable angle rail adapters 155, 160, 170 and 173 respectively. It will be appreciated by those of ordinary skill in the art that although carabiners 156, 161, 171 and 174 shown as being used as the connectors between the tethers and the variable angle rail adapters, other connectors may be utilized within the contemplation of this invention.

Figure 9:
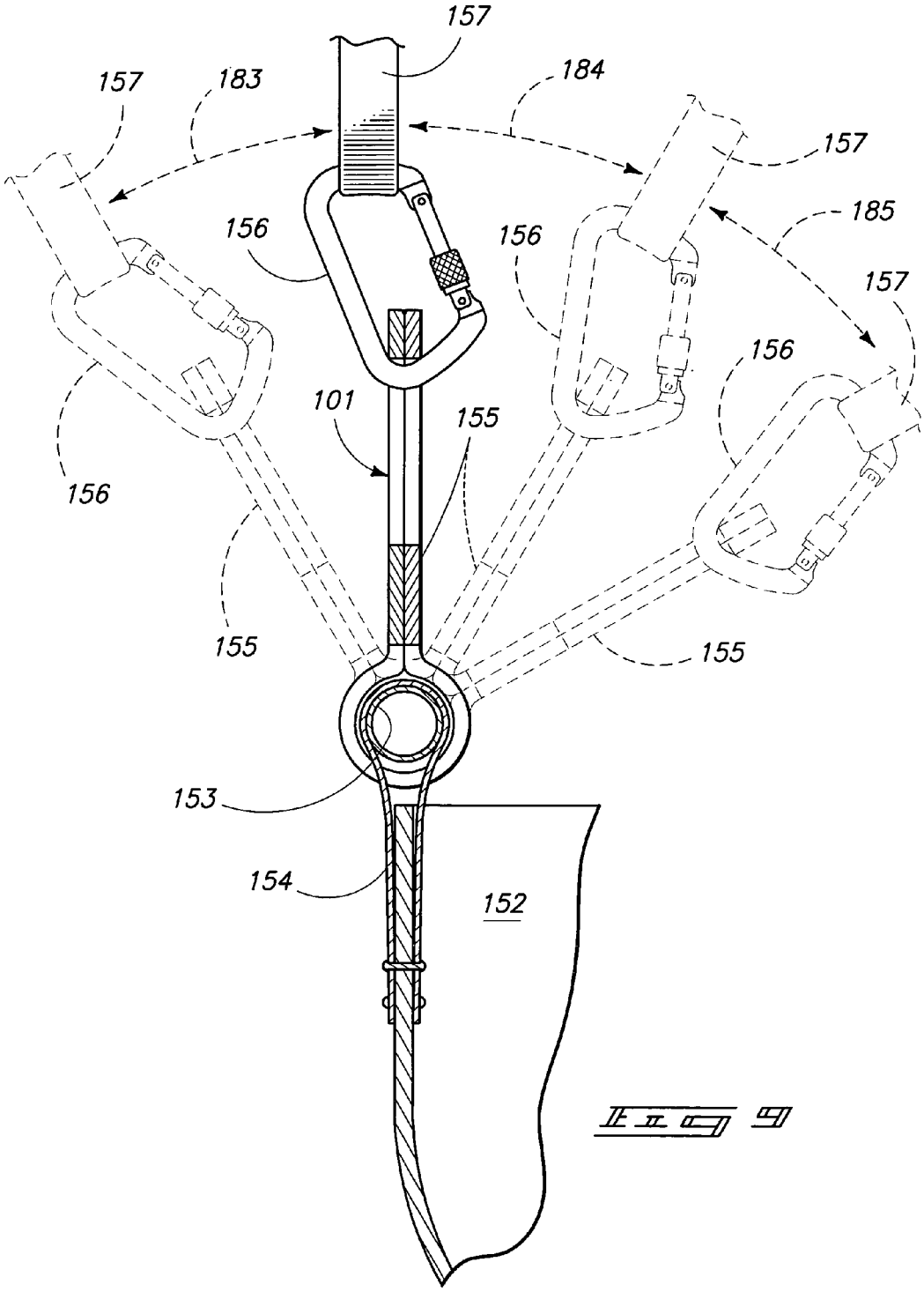
FIG. 9 Section 9-9 from FIG. 8 showing the embodiment of the variable angle rail adapter illustrated in FIG. 1 rotated about an axis of a rail to which it is attached.

FIG. 9 is section 9-9 from FIG. 8 showing the embodiment of the variable angle rail adapter illustrated in FIG. 1 rotated about an axis of a rail to which it is attached. FIG. 9 is a cross-section of further illustrating the options which are provided by the ability to rotate variable angle rail adapter 155 about its axis and about rail 153. Litter sidewall 152, litter component 154, tether 157 and carabiner 156 are also shown and arrows 183, 184 and 185 illustrate various positions and movement which may be accomplished by reason of the ability to rotate or pivot variable angle rail adapter 155 about rail 153. The carabiner shown is a screw type carabiner which may be securely attached between tether 157 and within a connector slot in attachment aperture 101 in variable angle rail adapter 155.

Figure 10:
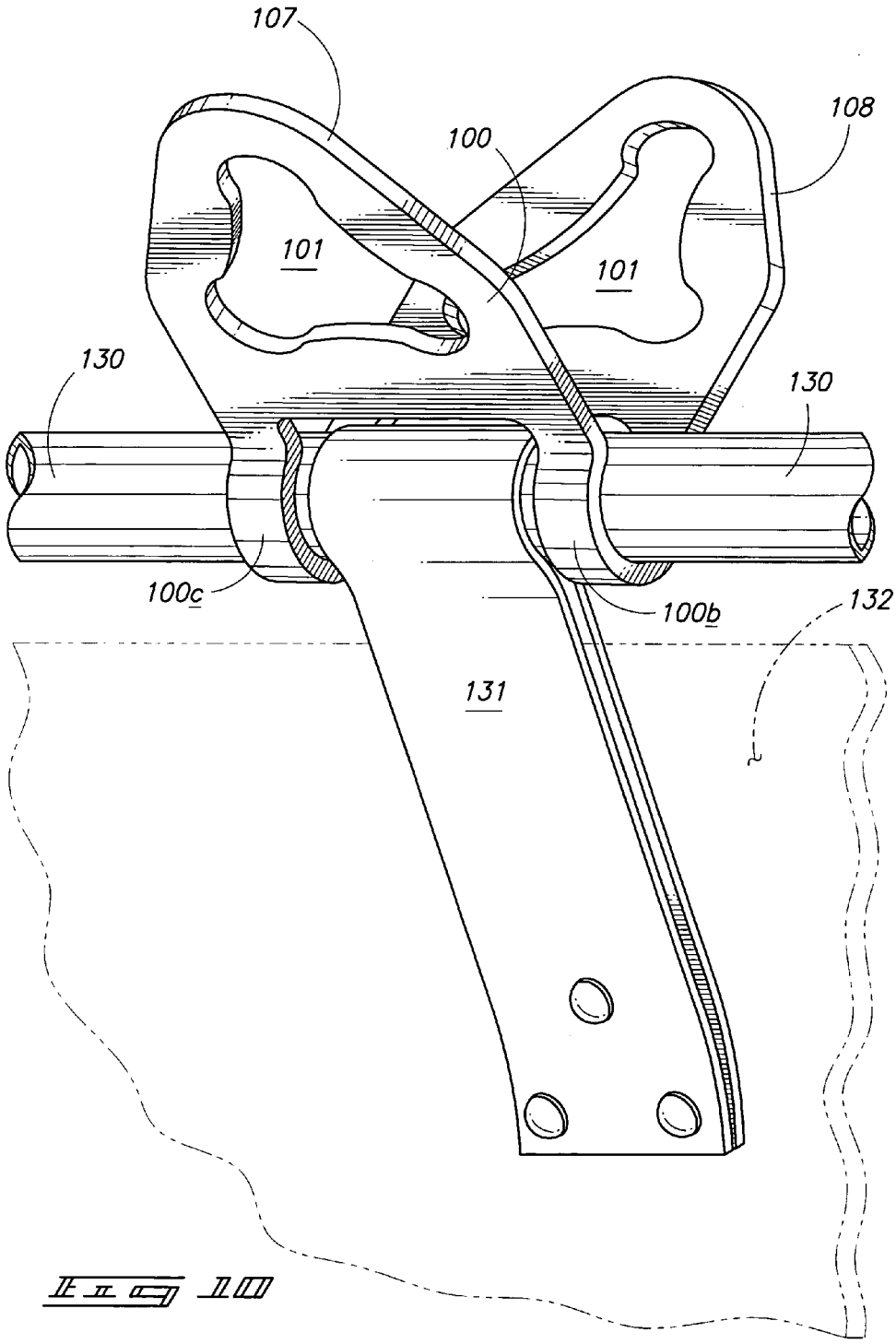
FIG. 10 is a front perspective view of the embodiment of the variable angle rail adapter shown being installed on a rail by wrapping it around the rail as indicated.
Figure 11:
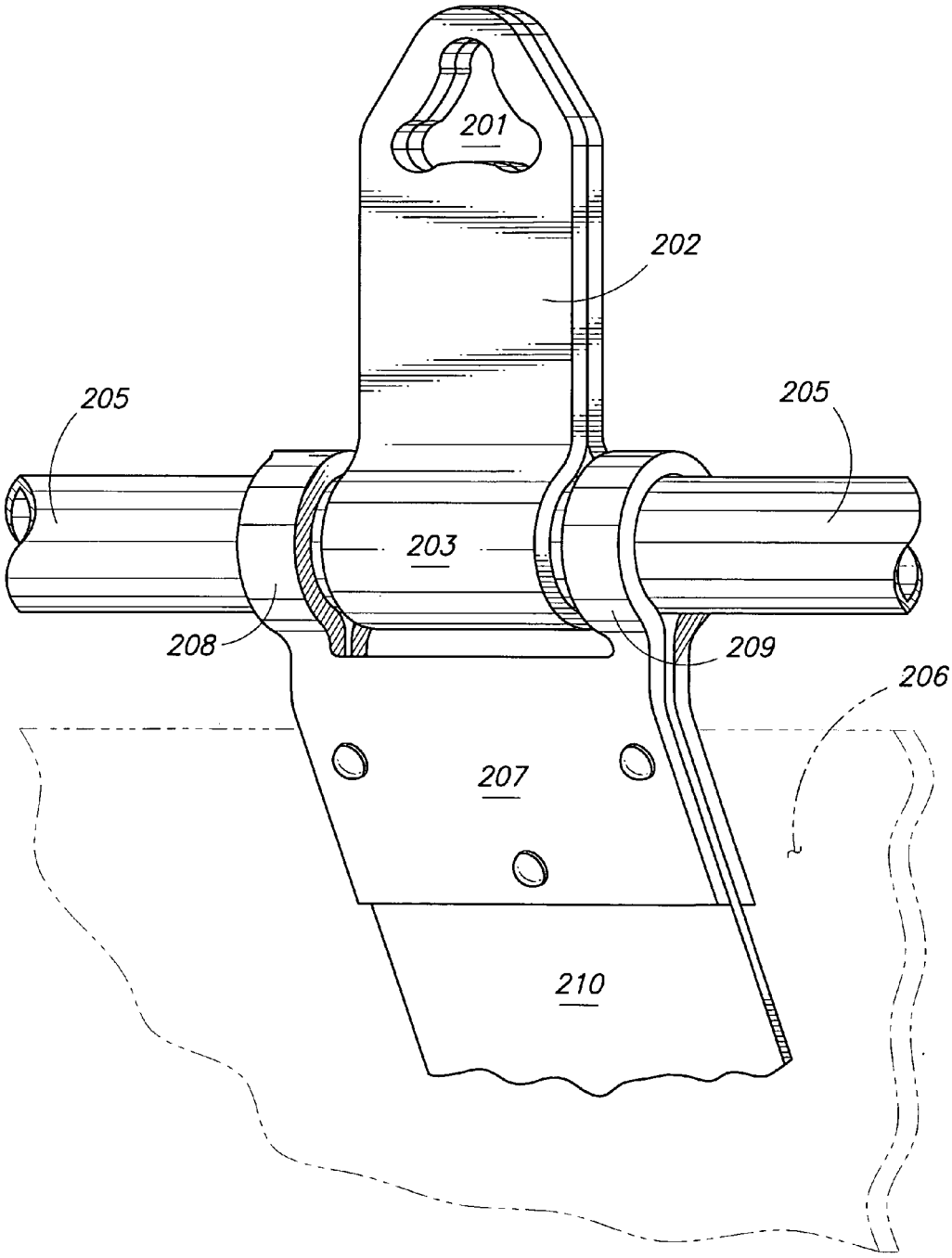

FIG. 10 is a front perspective view of the embodiment of the variable angle rail adapter shown being installed on a rail by wrapping it around the rail as indicated. FIG. 10 illustrates how the embodiment of the variable angle rail adapter 100 shown in FIG. 1 may easily be mounted to and assembled with a litter, more particularly with a rail 130 on a litter and a litter component 131. The first section 108 and the second section 107 of variable angle rail adapter 100 may be brought together and operatively connected by glue, welding or any one of a number of different means, thereby forming apertures within legs 100*c* and 100*b* to surround and pivot about rail 130.

Figure 11:
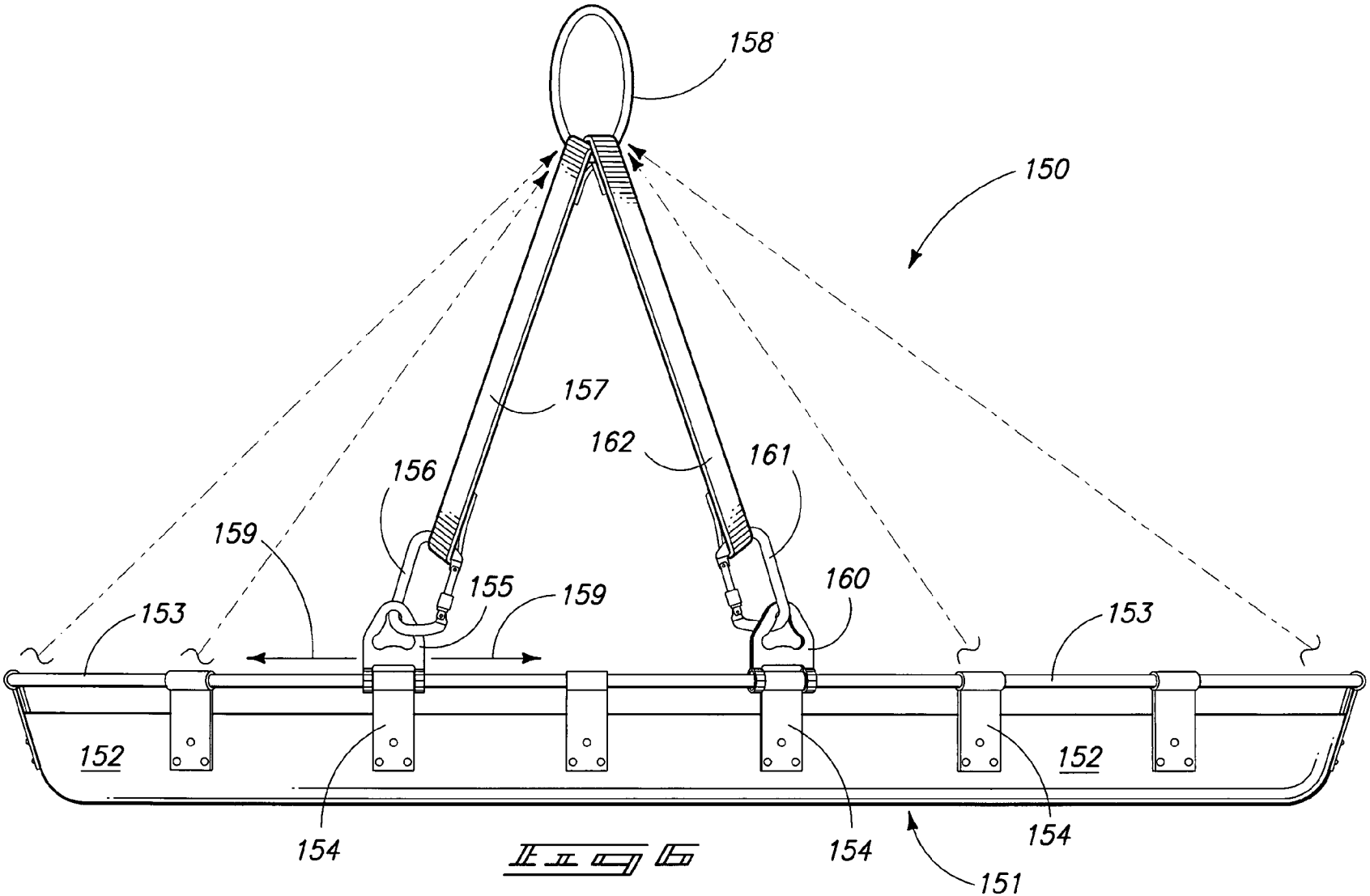
FIG. 11 is a front perspective view of another embodiment of the variable angle rail adapter, only wherein the structural component includes two rail apertures and the variable angle rail adapter includes one rail aperture.
Figure 11:
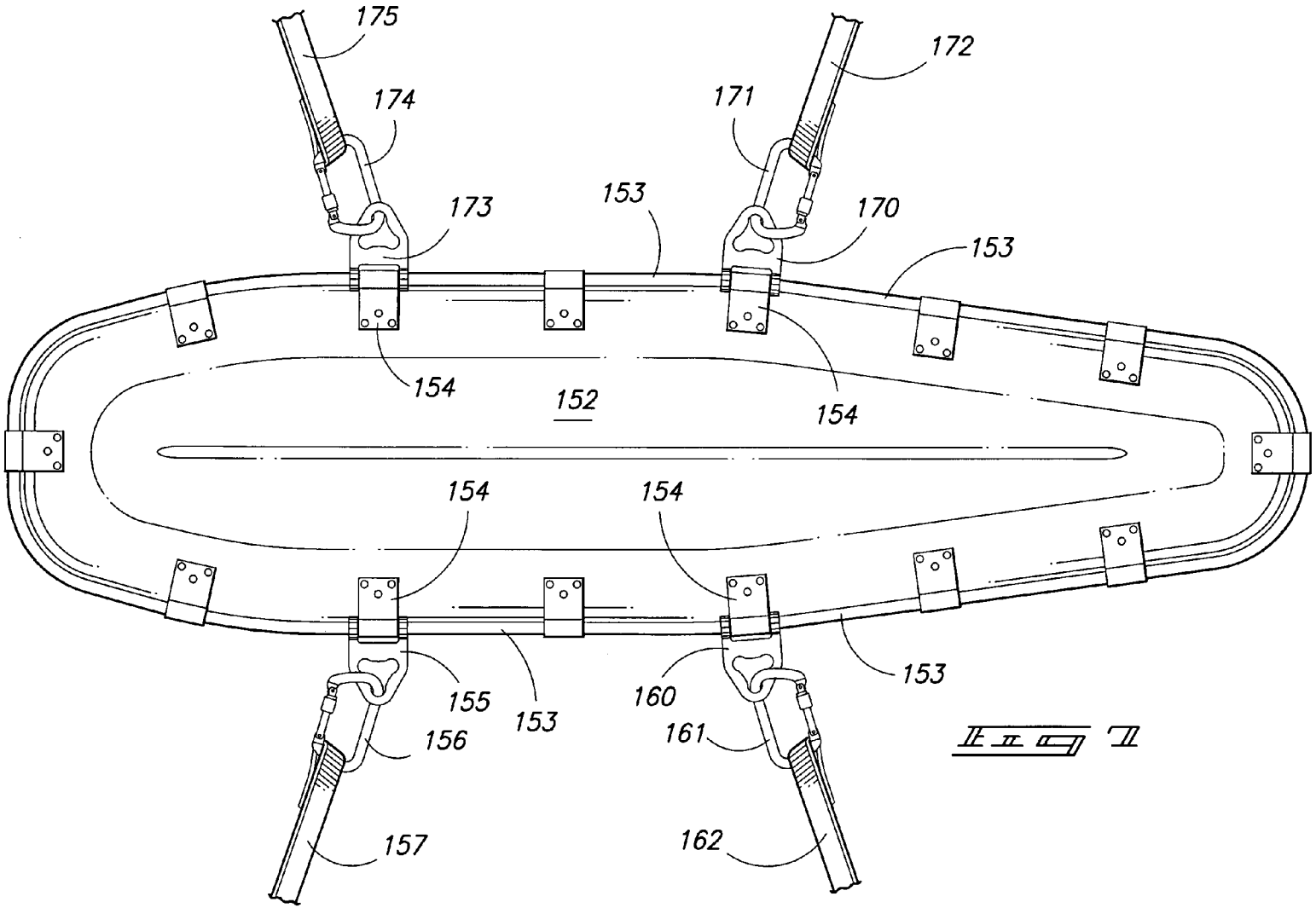

FIG. 11 is a front perspective view of another embodiment of the variable angle rail adapter 202, only wherein the litter framework component 207 includes two rail apertures 208 and 209 and the variable angle rail adapter 202 includes one rail aperture 203 and an attachment aperture 201. A rail 205, litter framework to 10 and litter component 206 are also shown in FIG. 11.

As will be appreciated by those of reasonable skill in the art, there are numerous embodiments to this invention, and variations of elements and components which may be used, all within the scope of this invention.

One embodiment of this invention, for example, is a rescue stretcher comprising: a framework including a top rail and a transverse framework component operatively attached to the top rail; a variable angle rail adapter comprising: an adapter body with a first rail aperture and a second rail aperture, each configured to rotatably mount around the top rail, an attachment aperture configured to receive an attachment component. Further embodiments of the foregoing may be: wherein the attachment aperture is oriented transverse to the first rail aperture and the second rail aperture; wherein the first rail aperture and the second rail aperture are sufficiently spaced apart to allow mounting on the top rail on opposing sides of a framework component; and/or wherein the attachment aperture includes a first nock, a second nock and a third nock configured to facilitate positioning of the attachment component therein.

In another embodiment of the invention, a rescue stretcher is provided which is comprised of: a framework including a top rail and a transverse framework component operatively attached to the top rail; a variable angle rail adapter comprising: an adapter body with at least one rail aperture rotably mounted around the top rail, the variable angle rail adapter including a transversely oriented attachment aperture configured to receive an attachment component.

In a still further embodiment of the invention, a variable angle rail adapter is provided for use on a rescue stretcher or litter, the adapter comprising an adapter body comprised of: a rail aperture configured for rotatable mounting around an axis of a stretcher rail or litter rail; and an attachment aperture transverse to the rail aperture. This embodiment may, but need not be further provided such that the attachment aperture includes a first nock, a second nock and a third nock configured to facilitate positioning of attachment components therein.

In yet another embodiment, a variable angle rail adapter for use on a rescue stretcher or litter, comprising: an adapter body with a first rail aperture configured to rotatably mount around a stretcher rail or litter rail and rotate about an axis of the stretcher rail or litter rail; with a second rail aperture spaced apart from the first rail aperture, and configured to rotatably mount around a stretcher rail or litter rail and rotate about an axis of the stretcher rail or litter rail; and an attachment aperture transverse to the first rail aperture and second rail aperture. Further and additional embodiments of the foregoing may be further wherein the attachment aperture includes a first nock, a second nock and a third nock configured to facilitate positioning of attachment components therein; and/or still further wherein the first rail aperture and the second rail aperture are sufficiently spaced apart to allow mounting on opposing sides of a framework component.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A rescue stretcher comprising:

a framework including a top rail and a transverse framework component operatively attached to the top rail, wherein the transverse framework component attaches to and separates portions of the top rail and provides a framework there-between;

a variable angle rail adapter comprising:

an adapter body with a first rail aperture and a second rail aperture, each configured to rotatably mount around the top rail, an attachment aperture configured to receive an attachment component, the attachment aperture being configured with two or more separate nocks therein to receive connectors or carabiners therein.

2. A rescue stretcher as recited in claim 1, and further wherein the attachment aperture is oriented transverse to the first rail aperture and the second rail aperture.

3. A rescue stretcher as recited in claim 1, and further wherein the first rail aperture and the second rail aperture are sufficiently spaced apart to allow mounting on the top rail on opposing sides of a framework component.

4. A rescue stretcher as recited in claim 1, and further wherein the attachment aperture includes a first nock, a second nock and a third nock configured to facilitate positioning of the attachment component therein.

5. A rescue stretcher comprising:

a framework including a top rail and a transverse framework component operatively attached to the top rail, wherein the transverse framework component attaches to and separates portions of the top rail and provides a framework there-between;

a variable angle rail adapter comprising:

an adapter body with at least one rail aperture rotatably mounted around the top rail, the variable angle rail adapter including a transversely oriented attachment aperture configured to receive an attachment component, the attachment aperture being configured with two or more separate nocks therein to receive connectors or carabiners therein.

6. A variable angle rail adapter for use on a rescue stretcher or litter, comprising:

an adapter body comprising:

a rail aperture configured for rotatable mounting around an axis of a stretcher rail or litter rail; and an attachment aperture transverse to the rail aperture configured to receive an attachment component, the attachment aperture being configured with two or more separate nocks therein to receive connectors or carabiners therein.

7. A variable angle rail adapter as recited in claim 6, and further wherein the attachment aperture includes a first nock, a second nock and a third nock configured to facilitate positioning of attachment components therein.

8. A variable angle rail adapter for use on a rescue stretcher or litter, comprising:

an adapter body with a first rail aperture configured to rotatably mount around a stretcher rail or litter rail and rotate about an axis of the stretcher rail or litter rail;

with a second rail aperture spaced apart from the first rail aperture, and configured to rotatably mount around a stretcher rail or litter rail and rotate about an axis of the stretcher rail or litter rail; and an attachment aperture transverse to the first rail aperture and second rail aperture, the attachment aperture being configured to facilitate positioning of an attachment component therein, and the attachment aperture being configured with two or more separate nocks therein to receive connectors or carabiners therein.

9. A variable angle rail adapter as recited in claim 8, and further wherein the attachment aperture includes a first nock, a second nock and a third nock configured to facilitate positioning of attachment components therein.

10. A variable angle rail adapter as recited in claim 8, and further wherein the first rail aperture and the second rail aperture are sufficiently spaced apart to allow mounting on opposing sides of a framework component.

11. A variable angle rail adapter as recited in claim 8, and further wherein the attachment aperture includes a first nock, a second nock and a third nock configured to facilitate positioning of attachment components therein;

wherein the first nock is configured to receive and position the attachment component in a transverse direction approximately perpendicular to the axis of the stretcher rail;

wherein the second nock is configured to receive and position the attachment component in a location between the first nock and the axis of the stretcher rail; and further wherein the third nock is configured to receive and position the attachment component in a location between the first nock and the axis of the stretcher rail, and on an opposing side of the attachment aperture to the second nock.

12. A rescue stretcher comprising:

a framework including a top rail and a transverse framework component operatively attached to the top rail, wherein the transverse framework component attaches to and separates portions of the top rail and provides a framework there-between;

a variable angle rail adapter for use on portions of the top rail on opposing sides of the transverse framework on, the variable angle rail adapter comprising:

an adapter body:

with a first rail aperture configured to rotatably mount around a stretcher rail or litter rail and rotate about an axis of the stretcher rail or litter rail;

with a second rail aperture spaced apart from the first rail aperture, and configured to rotatably mount around a stretcher rail or litter rail and rotate about an axis of the stretcher rail or litter rail; and an attachment aperture transverse to the first rail aperture and second rail aperture, the attachment aperture being configured to receive a tether for transporting the rescue stretcher, the attachment aperture being configured with two or more separate nocks therein to receive connectors or carabiners therein.

13. A rescue stretcher as recited in claim 12, and further wherein the attachment aperture includes a first nock, a second nock and a third nock configured to facilitate positioning of attachment components therein.

14. A rescue stretcher as recited in claim 12, and further wherein the attachment aperture includes a first nock, a second nock and a third nock configured to facilitate positioning of attachment components therein;

wherein the first nock is configured to receive and position the attachment component in a transverse direction approximately perpendicular to the axis of the stretcher rail;

wherein the second nock is configured to receive and position the attachment component in a location between the first nock and the axis of the stretcher rail; and further wherein the third nock is configured to receive and position the attachment component in a location between the first nock and the axis of the stretcher rail, and on an opposing side of the attachment aperture to the second nock.

* * * * *